United States Patent [19]

Vaguine

[11] 4,122,373

[45] Oct. 24, 1978

[54] STANDING WAVE LINEAR ACCELERATOR AND INPUT COUPLING

[75] Inventor: Victor A. Vaguine, Palo Alto, Calif.

[73] Assignee: Varian Associates, Inc., Palo Alto, Calif.

[21] Appl. No.: 754,650

[22] Filed: Dec. 27, 1976

Related U.S. Application Data

[63] Continuation-in-part of Ser. No. 546,379, Feb. 3, 1975, Pat. No. 4,024,426, which is a continuation of Ser. No. 420,754, Nov. 30, 1973, abandoned.

[51] Int. Cl.[2] ..... H01J 25/10

[52] U.S. Cl. ..... 315/5.41; 315/5.42; 315/39.53; 333/9

[58] Field of Search ..... 315/5.41, 5.42, 3.6, 315/39.53; 333/9

[56] References Cited

U.S. PATENT DOCUMENTS

| | | | |
|---|---|---|---|
| 2,813,996 | 11/1957 | Chodorow | 315/5.42 |
| 3,293,563 | 12/1966 | Nevins, Jr. | 315/3.6 |
| 3,546,524 | 12/1970 | Stark | 315/5.41 |
| 3,906,300 | 9/1975 | Tran | 315/5.41 |
| 3,958,192 | 5/1976 | Rootsey | 333/9 |
| 3,958,193 | 5/1976 | Rootsey | 333/9 |

*Primary Examiner*—Saxfield Chatmon, Jr.
*Attorney, Agent, or Firm*—Stanley Z. Cole; Leon F. Herbert

[57] ABSTRACT

A standing-wave linear charged particle accelerator is disclosed which comprises a plurality of interlaced substructures, with each substructure having a plurality of accelerating cavities disposed along the particle beam path and having side cavities disposed away from the beam path for electromagnetically coupling the accelerating cavities. A standing radio-frequency electromagnetic wave is supported in each substructure, with the wave in each substructure being phased with respect to the wave in every other substructure so that the particle beam will experience a maximum energy gain throughout its path through the accelerator. A single input waveguide is divided into plural branches to individually drive each of the substructures.

12 Claims, 6 Drawing Figures

STANDING WAVE LINEAR ACCELERATOR AND INPUT COUPLING

CROSS-REFERENCE TO RELATED APPLICATIONS

This is a continuation-in-part of U.S. patent application Ser. No. 546,379 filed Feb. 3, 1975, now U.S. Pat. No. 4,024,426, which is a continuation of Ser. No. 420,754, filed Nov. 30, 1973, now abandoned.

BACKGROUND OF THE INVENTION

This invention is a further development in the standing-wave linear charged particle accelerator art. More specifically the invention is an improvement upon the side-cavity coupled accelerator configuration as described by E. A. Knapp, B. C. Knapp and J. M. Potter in an article entitled "Standing Wave High Energy Linear Accelerator Structures", 39 *Review of Scientific Instruments* 979 (1968).

SUMMARY OF THE INVENTION

The accelerating cavities of two or more independent side-cavity coupled substructures are interlaced to form a single overall accelerator structure, with each substructure being energized with radio-frequency power in phased relation with the other substructures. This arrangement permits operation at higher power levels without radio-frequency breakdown, and increases the portion of the beam path along which the beam is acted upon by the radio-frequency field, as compared to single-substructure side-cavity coupled accelerators such as disclosed in the above-mentioned article by Knapp et al. Each substructure is preferably operated in the $\pi/2$ mode. The $\pi/2$ mode means each side cavity is 90° out of phase with each of the accelerating cavities to which it is coupled, and adjacent accelerating cavities in a given substructure are 180 degrees out of phase. Special coupling means are provided to independently energize each substructure with electromagnetic wave energy.

One of the objects of this invention is to provide an accelerator comprising interlaced side-cavity coupled substructures having a special arrangement for coupling input power to the various substructures from a single source.

Another object is to provide an input coupling arrangement which provides capability for coupling the same or different power to the various substructures from a single power source.

A further object is to provide an input coupling arrangement which provides a simple arrangement for obtaining the desired phase relation between the input to each of the various substructures.

An additional object is to provide an input coupling arrangement which provides substantial cancellation of any power reflected back from the substructure.

Other objects and advantages of this invention will be apparent upon a reading of the following specification in conjunction with the accompanying drawing.

DESCRIPTION OF A PREFERRED EMBODIMENT

Figure 1:
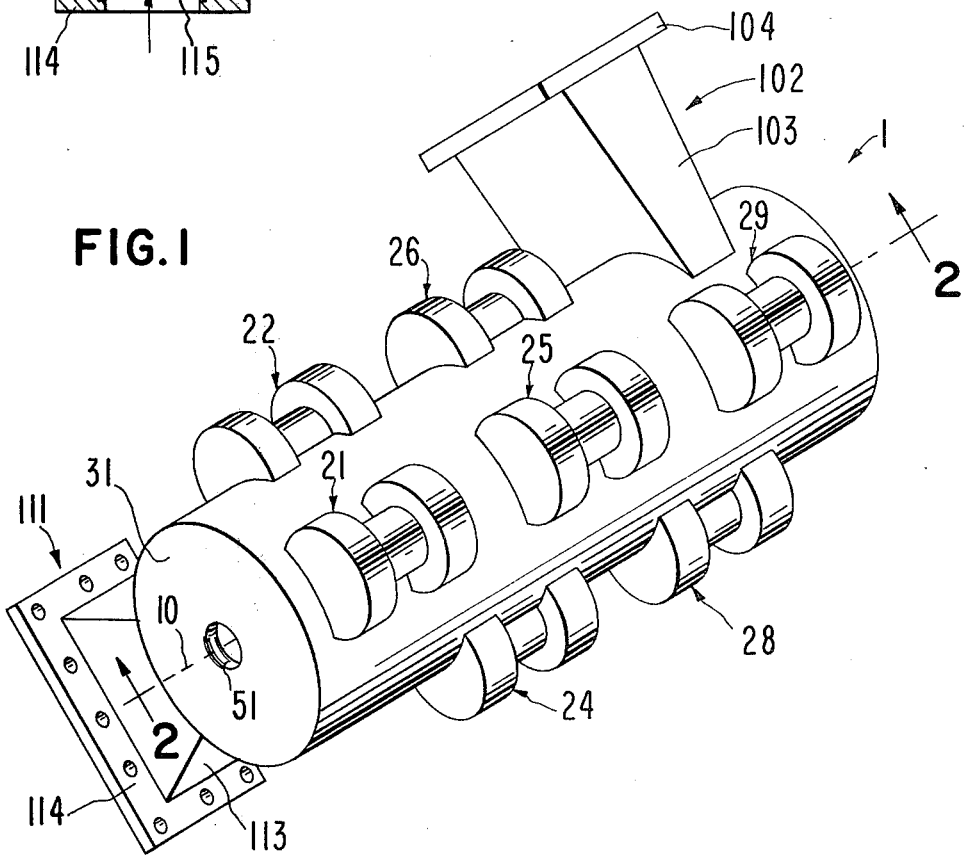
FIG. 1 is an oblique view of a standing-wave linear particle accelerator having two independent side-cavity coupled substructures interlaced according to this invention.

FIG. 1 shows an oblique view of a preferred embodiment of a standing-wave linear particle accelerator according to the teaching of this invention. The accelerator 1 has two interlaced side-cavity coupled standing-wave substructures with the side cavities of each substructure being disposed orthogonally with respect to the side cavities of the other substructure along a common axis 10. The axis 10 also defines the path of the charged particle beam through the accelerator 1. Each substructure comprises a series of accelerating cavities, with the accelerating cavities of one substructure being interlaced with the accelerating cavities of the other substructure as will be discussed in connection with FIGS. 2 and 3. For each substructure, the accelerating cavities are inductively coupled by side cavities. The side cavities are seen in FIG. 1 as projections from the generally cylindrical overall configuration of the accelerator 1. The accelerating cavities of one substructure, however, are electromagnetically decoupled from the accelerating cavities of the other substructure.

Also shown in FIG. 1 are radio-frequency power input guides 102 and 111 for energizing, respectively, each of the standing-wave substructures. A conventional charged particle source, e.g., an electron gun, not shown, injects a beam of charged particles through a beam entrance aperture 51 into the accelerator 1 along axis 10 from left to right as viewed in FIGS. 1, 2, and 3. The charged particles which are in phase with the accelerating field in the first accelerating cavity are captured and bunched. The formed bunch of the charged particles will pass through each successive accelerating cavity during a time interval when the electric field intensity in that cavity is a maximum. It is desirable that in each accelerating cavity the particles experience the maximum electric field intensity possible for the particular power level at which the accelerator 1 is being operated. In that way, the electromagnetic interaction of the charged particles with the electric field will result in the greatest possible transfer in energy from the field to the particles.

Figure 2:
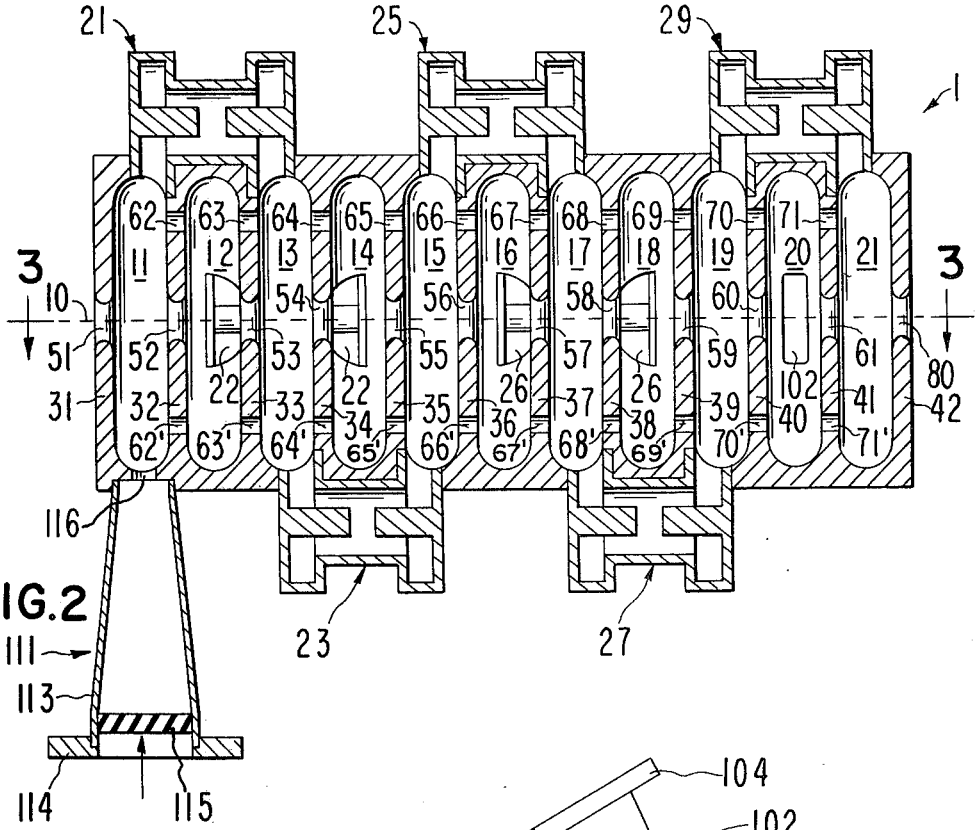
FIG. 2 is a sectional view of the accelerator taken on line 2—2 of FIG. 1.
Figure 3:
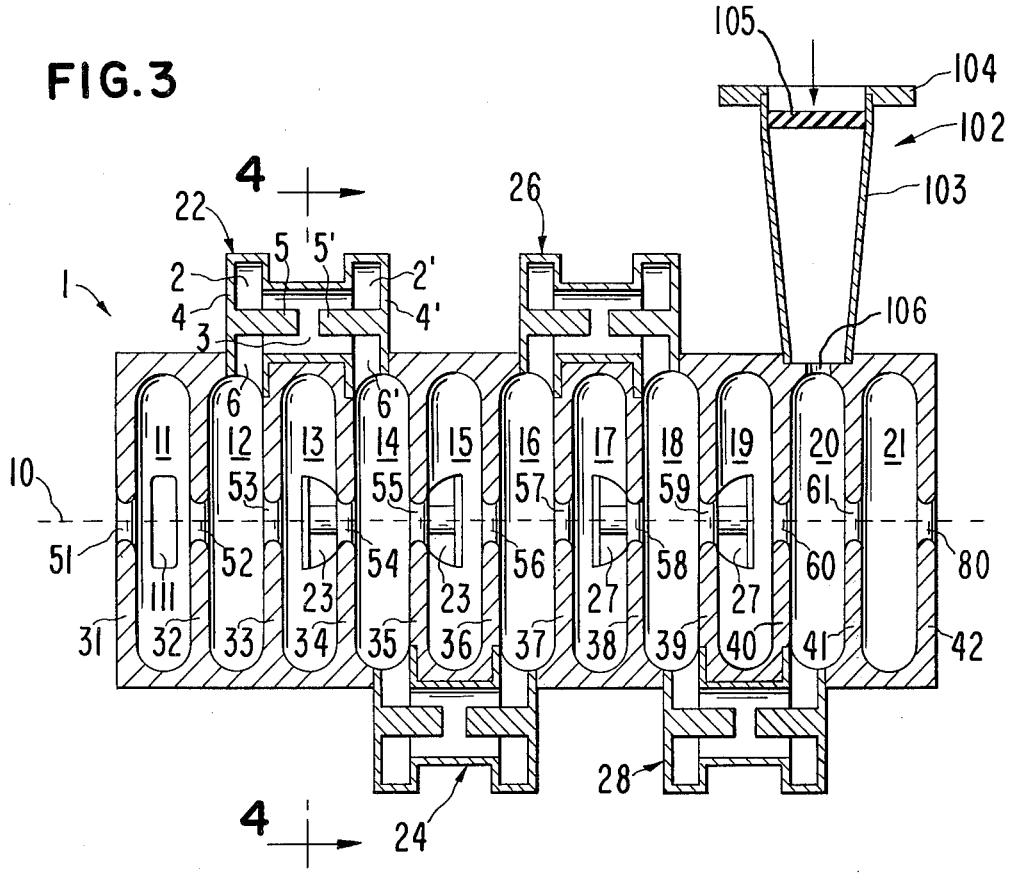
FIG. 3 is a sectional view of the accelerator taken on line 3—3 of FIG. 2.

FIG. 2 shows a cross-sectional view of accelerator 1 along the axis 10 of the particle beam. In the particular embodiment shown, there are eleven accelerating cavities 11, 12, 13, 14, 15, 16, 17, 18, 19, 20, 21. The odd-numbered accelerating cavities (11, 13, 15, 17, 19 and 21) form one standing-wave substructure, and the even-numbered (12, 14, 16, 18 and 20) accelerating cavities form another independent standing-wave substructure. The odd-numbered accelerating cavities are electrically coupled together by side cavities 21, 23, 25, 27 and 29. FIG. 3 shows another cross-sectional view of accelerator 1 along the axis 10 of the particle beam, orthogonal to the cross-sectional view of FIG. 2. In FIG. 3, the even-numbered accelerating cavities are shown electrically coupled together by side cavities 22, 24, 26 and 28. Each of the accelerating cavities 11 through 21 has a cylindrical configuration, and all these accelerating cavities are coaxially aligned along the axis 10. The first cavity 11 has an entrance wall 31 which extends perpendicular to the beam axis 10 and includes a circular beam entrance aperture 51 disposed coaxially with respect to the beam axis 10. A second wall 32, which also extends perpendicular to the beam axis 10, serves as a common wall between the accelerating cavity 11 and the accelerating cavity 12. The wall 32 also includes a central circular aperture 52 which is coaxially aligned with aperture 51 along the beam axis 10. The common wall 32 additionally includes a pair of magnetic coupling apertures 62 and 62' which are symmetrically disposed with respect to each other on opposite sides of the central aperture 52. These magnetic coupling apertures are located near the outer periphery of the wall 32, adjacent the regions in cavities 11 and 12 where the magnetic field approaches a maximum value and the electric field is very small. In principle, magnetic coupling between cavities 11 and 12 could be provided by a single coupling hole or by a plurality of coupling holes arranged, for example, in annular fashion around the outer periphery of wall 32. However, it has been found that the two diametrically opposed coupling holes 62 and 62' as shown in FIG. 2, of a size on the same order as the size of the central beam aperture 52, will provide adequate magnetic coupling between the adjacent cavities 11 and 12 to compensate for undesirable electric coupling through the central aperture 52. The net effect of the coupling of energy from cavity 11 into cavity 12 through aperture 52 is effectively cancelled by the simultaneous coupling of energy from cavity 12 back into cavity 11 through the magnetic coupling apertures 62 and 62'. As illustrated in FIGS. 2 and 3, the edges of the apertures 51 and 52 are rounded in order to reduce the electric field gradient at these apertures to a lower value than would result if drift tubes or non-rounded iris openings were provided.

The accelerating cavity 12 includes another wall 33 which serves as a common wall between cavity 12 and the next accelerating cavity 13. The wall 33 has a central aperture 53 which is coaxial with the beam axis 10, and a pair of magnetic coupling apertures 63 and 63' which are symmetrically disposed on opposite sides of the central aperture 53 in order to provide magnetic coupling between cavities 12 and 13 so as to compensate for any electrical coupling between these cavities through central aperture 53. The edges of the aperture 53 are rounded, as discussed above in connection with apertures 51 and 52, to reduce the electric field gradient at the iris openings between adjacent accelerating cavities.

The cavities 13, 14, 15, 16, 17, 18, 19, 20 and 21 include common walls 34, 35, 36, 37, 38, 39, 40, and 41, respectively, disposed between adjacent cavities so that all of the cavities are aligned along the beam axis 10. The common walls 34, 35, 36, 37, 38, 39, 40 and 41 each include one of a plurality of central beam apertures 54, 55, 56, 57, 58, 59, 60 and 61, respectively, which are also coaxially aligned with each other about the beam axis 10. Each of the walls 34, 35, 36, 37, 38, 39, 40 and 41 additionally includes a pair of magnetic coupling apertures 64 and 64', 65 and 65', 66 and 66', 67 and 67', 68 and 68', 69 and 69', 70 and 70', and 71 and 71', respectively, which are symmetrically disposed on opposite sides of the central apertures 54, 55, 56, 57, 58, 59, 60 and 61, respectively, and serve to magnetically couple the adjacent accelerating cavities 13 and 14, 14 and 15, 15 and 16, 16 and 17, 17 and 18, 18 and 19, 19 and 20, and 20 and 21, respectively. This magnetic coupling of adjacent cavities compensates for any electric coupling that occurs through the central beam apertures in the walls separating the adjacent cavities. The beam apertures 54, 55, 56, 57, 58, 59, 60 and 61 are likewise rounded to reduce the electric field gradient at the iris openings between adjacent accelerating cavities. An exit wall 42 having a central beam exit aperture 80 aligned with the beam axis 10 is disposed on the opposite side of the accelerating cavity 21 from the wall 41 and serves to complete the accelerating cavity structure. It is noted that the accelerator 1 is an evacuated structure. For the embodiment shown in the drawing, it is necessary that the beam entrance aperture 51 and the beam exit aperture 80 be covered by windows which are impermeable to gas in order that vacuum-tight integrity of the structure can be maintained yet which are permeable to the beam particles at the energies at which these particles respectively enter into or exit from the accelerator 1. An alternative arrangement with respect to the beam entrance aperture 51 would be to dispose a preaccelerator structure, or the charged particle source, immediately adjacent the aperture 51, such as by vacuum-tight flange connection, in such a way that charged particles could be injected directly through aperture 51 into the evacuated accelerator 1 without the necessity of any window material covering the aperture 51. In an x-ray device the closure wall for aperture 80 would carry an x-ray generating target to be struck by the beam passing through aperture 80. If the accelerator is used only for charged particles that can be collimated into a very narrow beam, it is possible for the central beam apertures to be made so small that electrical coupling between adjacent accelerating cavities will be negligible. In that case, the magnetic coupling apertures are unnecessary and can be eliminated.

The accelerating cavity 11 is inductively coupled through a side cavity 21 to the accelerating cavity 13, as shown in FIG. 2. A second side cavity 22, as shown in FIG. 3, is disposed ninety degrees around the beam axis 10 from side cavity 21 and provides similar inductive coupling between the two accelerating cavities 12 and 14. A third side cavity 23, as shown in FIG. 2, is disposed ninety degrees around the beam axis 10 beyond side cavity 22 and provides coupling between the two accelerating cavities 13 and 15. A fourth side cavity 24 is disposed ninety degrees around the beam axis 10 beyond side cavity 23 and provides coupling between the two accelerating cavities 14 and 16. In a like manner, a fifth side cavity 25 is disposed ninety degrees around the beam axis 10 beyond side cavity 24, in alignment with the side cavity 21, and provides coupling between the two accelerating cavities 15 and 17. Similarly, a sixth side cavity is disposed 90° around the beam axis 10 beyond side cavity 25, in alignment with the side cavity 22, and provides coupling between the two accelerating cavities 16 and 18. A seventh side cavity 27 is disposed an additional ninety degrees around the beam axis 10, in alignment with the side cavity 23, and provides coupling between the accelerating cavities 17 and 19. Similarly, an eighth side cavity 28 is disposed an additional ninety degrees around the beam axis 10 beyond side cavity 27, in alignment with the side cavity 24, and provides coupling between the two accelerating cavities 18 and 20. A ninth side cavity 29 is disposed ninety degrees further around the beam axis 10, in alignment with side cavities 21 and 25, and provides coupling between the two accelerating cavities 19 and 21.

Figure 4:
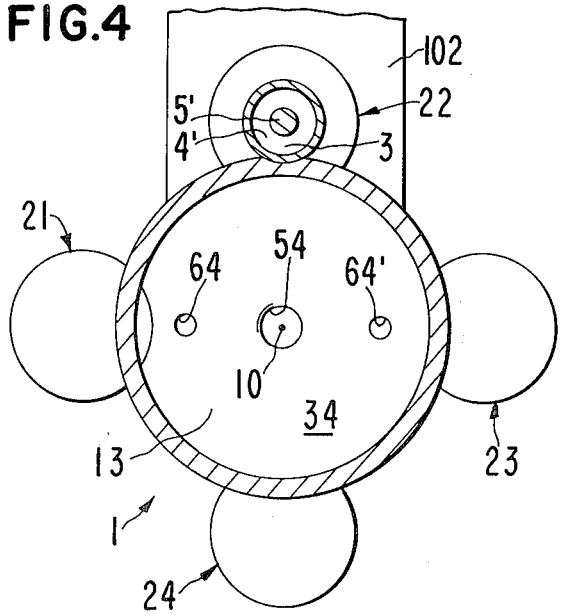
FIG. 4 is a sectional view of an accelerating cavity of the accelerator taken on line 4—4 of FIG. 3.

In principle, the side cavities 21 through 29 could be configured in the conventional manner as illustrated, for example, in the aforecited article by E. A. Knapp, et al. It is preferable, however, to modify the conventional configuration of the side cavities in order to accommodate the interposition between each pair of coupled accelerating cavities of an independently energized accelerating cavity. Thus, the configuration of side cavity 22 is designed, as best shown in FIG. 3, to accommodate the interposition of accelerating cavity 13 between the accelerating cavities 12 and 14 which are electrically coupled by the side cavity 22. In particular, cavity 22, instead of being configured as a single cylinder according to the conventional manner, is configured as a combination of three coaxial cylinders 2, 3 and 2'. One end of cylinder 2 is partially bounded by wall 4, and the other end is in open communication with cylinder 3. Cylinder 3 is coaxial with but of smaller diameter than cylinders 2 and 2', and is in open communication at each end with cylinders 2 and 2' to form the interior chamber of the side cavity 22. Cylinder 2' has the same diameter and axial length as cylinder 2, and is partially bounded by wall 4' on the end opposite cylinder 3. The axial length of cylinder 3 is equal to the distance between the outside surfaces of walls 33 and 34 of the accelerating cavity 13, as seen in FIG. 3. The diameter of cylinder 3 is less than the diameter of cylinders 2 and 2' by an amount sufficient to permit cylinders 2 and 2' to have a conventionally determined diameter while allowing accelerating cavity 13 to be coaxial with and to have the same dimensions as accelerating cavities 12 and 14. Metal post 5 projecting from wall 4 and metal post 5' projecting from wall 4' are symmetrically disposed along the commom axis of cylinders 2, 3, and 2' whereby the gap between posts 5 and 5' can provide the capacitance necessary for tuning the side cavity 22 to the same frequency as the accelerating cavities 12 and 14. FIG. 4 shows in detail a cross-sectional view through accelerating cavity 13 and side cavity 22. Side cavity 22 communicates with accelerating cavity 12 through iris 6 and with accelerating cavity 14 through iris 6', where irises 6 and 6' are inductive coupling irises. The other side cavities 24, 26 and 28 shown in FIG. 3, and the side cavities 21, 23, 25, 27 and 29 shown in FIG. 4, are constructed in the same manner as described above for side cavity 22. The accelerating cavities and the side coupling cavities of a particular substructure are all tuned to be resonant at essentially the same frequency. For practical application it is contemplated that the cavities will be resonant at S-band.

As illustrated in FIGS. 1 and 3, a first radio-frequency power input waveguide 102 communicates with the accelerating cavity 20 through iris 106 for coupling energy to the even-numbered accelerating cavities. The waveguide 102 comprises a rectangular guide member 103, a mounting flange 104 affixed thereto, and a radio-frequency window 105 sealed thereacross to permit passage of radio-frequency energy into the accelerating cavity 20 while forming a portion of the vacuum envelope of the accelerator 1. Similarly, a second radio-frequency power input waveguide 111, comprising a rectangular guide member 113, a mounting flange 114 and a radio-frequency window 115, communicates with the accelerating cavity 11 through iris 116 for coupling energy to the odd-numbered accelerating cavities. In principle, radio-frequency energy could be coupled to any one of the accelerating cavities of each substructure to set up a standing wave in that substructure. It is convenient, however, to locate the power input waveguides 102 and 111 at opposite ends of the accelerator 1 in order to accomodate the physical dimensions of the waveguides. Since the substructure comprising the accelerating cavities 11, 13, 15, 17, 19 and 21 is electromagnetically discoupled from the substructure comprising the accelerating cavities 12, 14, 16, 18 and 20, each substructure could be energized to support a standing wave of a different frequency. However, it is contemplated that the same frequency input power will ordinarily be coupled into each substructure. For a two-substructure accelerator as shown in the drawing with each substructure operating in the $\pi/2$ mode, maximum energy can be transferred to the beam of charged particles, and hence the maximum output beam energy can be obtained, when the standing wave in one substructure is out of phase with the standing wave in the other substructure by 90° (i.e., when the phase of the accelerating field in cavity 12 lags the phase of the accelerating field in cavity 11 by 90°). The charged particles are synchronized with the radio-frequency accelerating fields through the entire length of the accelerator be well-known techniques which take into account the length of the accelerating cavities and the frequency of the field. For an accelerator having a number of independent substructures greater than two, and each substructure operating in the $\pi/2$ mode, the maximum output beam energy can be obtained when each successive downstream substructure is dephased to lag the next preceding upstream substructure by 180° divided by N (where N is the number of substructures). Thus, for a charged particle beam of a given intensity, by adjusting the dephasing between adjacent accelerating cavities it is possible to adjust the output beam energy of the accelerator from a maximum value down to a value approximately equal only to the energy possessed by the particles as they enter the accelerator. The general statement of phase difference ($P_c$) between adjacent accelerating cavities of the combined accelerator of this invention for maximum energy gain, regardless of the mode of operation of the individual substructures, or number of substructures (N), is given by the expression $P_c = P_s/N$ (where $P_s$ is the phase difference between adjacent accelerating cavities of each individual substructure).

Although the illustrated embodiments of the invention show only two interlaced substructures, it is clear that three, four, or even more substructures might be similarly interlaced.

Figure 5:
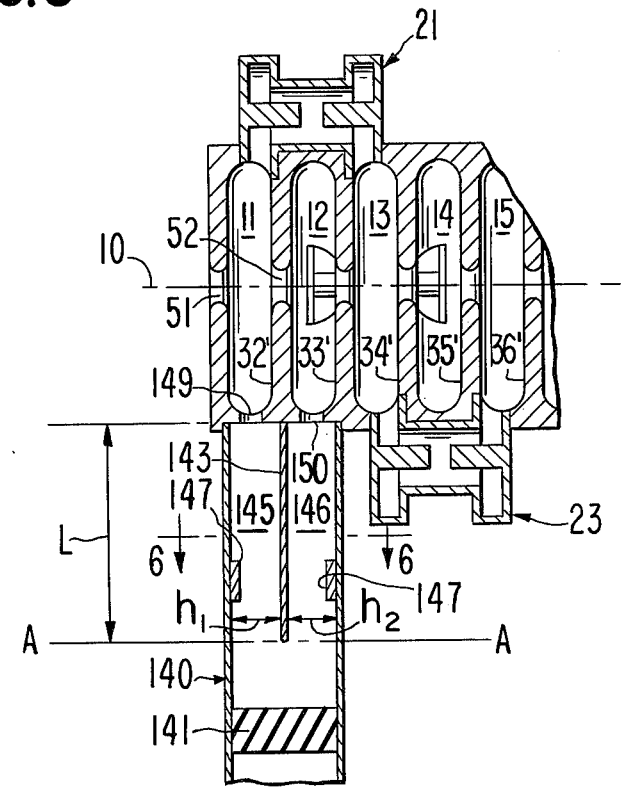
FIG. 5 is a sectional view repeating the left portion of the accelerator of FIG. 2 but showing a different input coupling.
Figure 6:
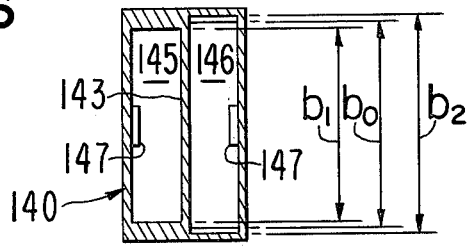
FIG. 6 is a sectional view on the line 6—6 of FIG. 5.

In addition to the separate input waveguide arrangement of FIG. 1, there is another arrangement which has several special benefits. Said other arrangement is shown in FIGS. 5 and 6 wherein the reference numbers used in FIGS. 1–4 are also used where the structure is the same. FIG. 5 depicts the previously mentioned arrangement in which the cavity walls 32', 33' etc. do not contain magnetic coupling apertures, but of course such apertures can be employed with the input waveguide means of FIGS. 5 and 6 whenever desirable as explained in respect to FIGS. 1–4.

As shown in FIGS. 5 and 6, the accelerating cavities 11 and 12 are driven from a single radio frequency power input waveguide 140 which is specially designed to feed a cavity from each of two substructures, e.g. cavities 11 and 12. The waveguide is hermetically sealed by a conventional dielectric window 141. On the vacuum side of the window, the waveguide 140 is divided by a metal wall 143 into two smaller waveguides 145 and 146. The free lower edge of wall 143 is preferably rounded to avoid field concentrations, and metal posts 147 are preferably employed to counteract any field deformations caused by wall 143. Waveguide 145 couples to cavity 11 through an iris 149, and waveguide 146 couples to cavity 12 through an iris 150.

The power delivered through the small waveguides can either be the same for each waveguide 145 and 146 or can be divided unequally between them by locating wall 143 to the right or left of its centered position shown in FIG. 5. More specifically the ratio of power delivered through waveguide 145 to power delivered through waveguide 146 is approximately equal to the ratio of $h_1/h_2$, where $h_1$ and $h_2$ are the dimensions shown in FIG. 5. This variable power capability is useful for example where there are more accelerating cavities in one substructure than in the other. In such case, it is desirable to deliver higher power to the substructure having the larger number of cavities, e.g. where there are three accelerating cavities in one substructure and two in the other, the three-cavity substructure would be driven with 3/5 of the total available power and the two-cavity substructure would be driven with 2/5 of the total power. It will be understood that off-center positioning of the dividing wall 143 does not perturb the transverse electric modes wherein the wall is perpendicular to the electric field for such mode, such as the $TE_{01}$ mode.

The coupler shown in FIGS. 5 and 6 is also easily adapted to provide a desired phase difference between cavities 11 and 12 such as the 90° phase difference required for maximum acceleration in the case of two substructures each operating in the $\pi/2$ mode. The phase difference is a function of the relationship between coupler length L (FIG. 5) and the widths $b_1$ and $b_2$ (FIG. 6), where $b_0$ is the width of the undivided section of waveguide 140 below wall 143.

The coupler of FIGS. 5 and 6 also provides substantial cancellation of power reflected from the accelerator in the event the input frequency becomes detuned from the resonant frequency of the accelerating cavities, particularly in the case of identical substructures and equal power through guides 145 and 146. This cancelling effect occurs because the reflected waves from the even and odd numbered cavities have a phase difference equal to 180° (double the incoming phase difference) in the plane A—A at the free end of wall 143.

It should be understood that if the type of input waveguide coupler of FIGS. 5 and 6 is used with more than two substructures, plural walls 143 will be required, one less in number than the number of substructures.

Although this invention has been described with respect to preferred embodiments, it will be readily apparent to those skilled in the art that various changes in form and arrangement of parts may be made to suit requirements without departing from the spirit and scope of the invention as defined by the following claims.

What is claimed is:

1. A standing wave accelerator for charged particle beams comprising wall means forming a plurality of accelerating cavities, each of said accelerating cavities being adapted to support a standing wave therein, beam passage apertures formed in said wall means between adjacent accelerating cavities, resonant coupling means displaced from said apertures and interconnecting accelerating cavities which are not adjacent to each other to form a substructure which will support a standing wave independent from a standing wave in an adjacent accelerating cavity, all of said accelerating cavities having substantially the same resonant frequency, wall means forming an input waveguide connected to said accelerator, said waveguide having internal dividing wall means for dividing the input waveguides into a plurality of separate waveguide passages, one of the accelerating cavities in said substructure having a coupling iris communicating with one of said separate waveguide passages, and one of said accelerating cavities not in said substructure having a coupling iris communicating with another of said separate waveguide passages.

2. An accelerator as claimed in claim 1 wherein said separate waveguide passages are connected to accelerating cavities which are adjacent to each other.

3. An accelerator as claimed in claim 1 wherein alternate accelerating cavities are connected to each other via said resonant coupling means to form two of said substructures.

4. An accelerator as claimed in claim 3 wherein said separate waveguide passages are connected to accelerating cavities which are adjacent to each other.

5. An accelerator as claimed in claim 4 wherein said resonant coupling means causes the adjacent coupled cavities to operate 180° out of phase with each other, and said wave dividing means divides the total input wave into two waves 90° out of phase with each other.

6. An accelerator as claimed in claim 1 wherein said input waveguide has a rectangular internal cross-section and said wave dividing wall means intersects two opposite walls of said waveguide, said dividing wall means comprising one less dividing wall than the number of accelerating cavities coupled to said input waveguide.

7. An accelerator as claimed in claim 6 wherein the internal distance between said opposite walls is greater on one side of said dividing wall means than on the other.

8. An accelerator as claimed in claim 7 wherein the difference between said internal distances on opposite sides of said dividing wall means is such that the input wave on one side of said dividing wall means is ninety degrees out of phase with the input wave on the other side of said dividing wall means.

9. An accelerator as claimed in claim 6 wherein a perturbing projection is provided on each wall of said wave guide opposite said dividing wall means.

10. An accelerator as claimed in claim 1 wherein there are a plurality of said substructures each comprising a plurality of coupled accelerating cavities, and the accelerating cavities of one substructure being directly adjacent an accelerating cavity of a different substructure.

11. An accelerator as claimed in claim 10 wherein there are more accelerating cavities in one substructure than in another substructure, and said dividing wall means is a asymmetrically positioned in said wave guide to provide more power to the substructure having more accelerating cavities than to the substructure having a lesser number of accelerating cavities.

12. A standing wave accelerator for charged particle beams comprising wall means forming a plurality of accelerating cavities, each of said accelerating cavities being adapted to support a standing wave therein, beam passage apertures formed in said wall means between adjacent accelerating cavities, first resonant coupling means displaced from said apertures and interconnecting accelerating cavities which are not adjacent to each other to form a first substructure of coupled cavities which will support a standing wave, at least a second resonant coupling means displaced from said apertures and interconnecting other accelerating cavities which are not adjacent to each other to from at least a second substructure which will support a standing wave independent from a standing wave in said first substructure, all of said accelerating cavities having substantially the same resonant frequency, all of said resonant coupling means being constructed to provide a phase difference $P_s$ between adjacent accelerating cavities of each substructure, and means for driving each substructure to provide a phase difference $P_c$ between adjacent cavities, and $P_s$ and $P_c$ complying with the expression $P_c = P_s/N$ (where $N$ is the number of substructures).

* * * * *